United States Patent [19]

Baker et al.

[11] Patent Number: 4,919,204

[45] Date of Patent: Apr. 24, 1990

[54] APPARATUS AND METHODS FOR CLEANING A WELL

[75] Inventors: Walter Baker, Lewisville; Malcolm N. Council, Richardson, both of Tex.

[73] Assignee: Otis Engineering Corporation, Dallas, Tex.

[21] Appl. No.: 298,688

[22] Filed: Jan. 19, 1989

[51] Int. Cl.[5] ..... E21B 37/00

[52] U.S. Cl. ..... 166/223; 166/312; 166/77; 175/67; 175/100; 175/424

[58] Field of Search ..... 166/222, 223, 312, 170, 166/173, 177, 77, 384; 15/104.061; 134/22.11, 22.12; 299/17; 175/424

[56] References Cited

U.S. PATENT DOCUMENTS

| | | | |
|---|---|---|---|
| 1,695,749 | 12/1928 | Watson | 166/223 X |
| 1,715,767 | 6/1929 | Le Flore | 166/223 |
| 2,186,309 | 1/1940 | Travis | 166/223 X |
| 2,675,753 | 11/1953 | Carpenter | 166/223 X |
| 2,785,875 | 3/1957 | Hayes | 166/223 X |
| 3,285,485 | 11/1966 | Slator | 226/172 |
| 3,313,346 | 4/1967 | Cross | 166/77 X |
| 3,559,905 | 2/1971 | Palynchuk | 242/54 |
| 3,720,264 | 3/1973 | Hutchison | 166/311 |
| 3,811,499 | 5/1974 | Hutchison | 166/67 |
| 3,829,134 | 8/1974 | Hutchison | 285/14 |
| 3,844,362 | 10/1974 | Elbert et al. | 166/223 X |
| 3,850,241 | 11/1974 | Hutchison | 166/222 |
| 4,088,191 | 5/1978 | Hutchison | 166/223 |
| 4,349,073 | 9/1982 | Zublin | 166/312 |
| 4,441,557 | 4/1984 | Zublin | 166/312 |
| 4,442,899 | 4/1984 | Zublin | 166/312 |
| 4,518,041 | 5/1985 | Zublin | 166/312 |
| 4,625,799 | 12/1986 | McCormick et al. | 166/223 |
| 4,705,107 | 11/1987 | Council et al. | 166/223 X |
| 4,781,250 | 11/1988 | McCormick et al. | 166/240 |
| 4,799,544 | 1/1989 | Clapp et al. | 166/312 |

OTHER PUBLICATIONS

HYDRA-BLAST ® Services Brochure-(OEC 5506), Jun. 1988.

Garlock, Inc.-DU Bearing Brochure, pp. 2-5, 1975.

*Primary Examiner*—Stephen J. Novosad

*Attorney, Agent, or Firm*—Thomas R. Felger

[57] ABSTRACT

Apparatus for pressurized cleaning of well flow conductors. The apparatus has a non-rotating inner mandrel, an adapter to connect the inner mandrel to a work string, a rotating housing on the exterior of the inner mandrel, and a nozzle body attached to the housing. An alternative embodiment of the invention allows cleaning tools to be attached to a modified nozzle body and rotated therewith. Fluid pressure flowing through the inner mandrel will cause the housing to rotate relative to the inner mandrel. Rotation is used to direct fluid jets in the nozzle body towards different portions of the interior of the flow conductor. Rotation of a cleaning tool can also be used for combined mechanical and hydraulic drilling to remove deposits from within a well flow conductor.

14 Claims, 2 Drawing Sheets

APPARATUS AND METHODS FOR CLEANING A WELL

BACKGROUND OF THE INVENTION

1. Field of the Invention

This invention relates to the servicing of wells by use of small diameter work strings and more particularly to removal of scale and other downhole deposits from the inside diameter of well tubulars.

2. Description of the Prior Art

It has been common practice for many years to run a continuous reeled pipe (known extensively in the industry as "coil tubing") into a well to perform operations utilizing the circulation of treating and cleanout fluids such as water, oil, acid, corrosion inhibitors, hot oil, nitrogen, foam, etc. Coil tubing, being continuous rather than jointed, is run into and out of a well with continuous movement of the tubing through a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing and drill out such obstructions. Turbo-type drills have been used but develop insufficient torque for many jobs. Other devices have been used to attempt removal of foreign material from the interior of well tubulars. These well tubulars vary from unperforated and perforated pipe, large diameter casing, production tubing, and slotted or wire-wrapped well liners. Well tubulars often become plugged or coated with corrosion products, sediments and hydrocarbon deposits. The deposits may consist of silicates, sulphates, sulphides, carbonates, calcium, and organic growth.

It is desirable to perform drilling type operations in wells through use of coil tubing which can be run into and removed from a well quickly in addition to performing the usual operations which require only the circulation of fluids. The same types of well servicing can also be performed with various small diameter work strings. The present invention may be used with such work strings and is not limited to coil tubing. For example, a work string consisting of one inch jointed pipe may be insert through a two inch production tubing string to hydraulically clean the inside diameter of five inch casing below the end of the tubing string.

U.S. Pat. No. 3,285,485 which issued to Damon T. Slator on Nov. 15, 1966, discloses a device for handling tubing and the like. This device is capable of injecting reeled tubing into a well through suitable seal means, such as a blowout preventer or stripper, and is currently commonly known as a coil tubing injector. U.S. Pat. No. 3,313,346 issued Apr. 11, 1967 to Robert V. Cross and discloses methods and apparatus for working in a well using coil tubing. U.S. Pat. No. 3,559,905 which issued to Alexander Palynchuk on Feb. 2, 1971 discloses an improved coil tubing injector.

High pressure fluid jet systems have been used for many years to clean the inside diameter of well tubulars. Examples of such systems are disclosed in the following U.S. Pat. Nos.: 3,720,264, 3,811,499, 3,829,134, 3,850,241, 4,088,191, 4,349,073, 4,441,557, 4,442,899, 4,518,041.

Outside the oil and gas industry, tubing cleaners have been used for many years to remove scale and other deposits from the inside diameter of tubes used in heat exchangers, steam boilers, condensers, etc. Such deposits may consist of silicates, sulphates, sulphides, carbonates, calcium, and organic growth.

Wire brushes, scrapers, scratchers and cutters of various designs were among the first tools used to try to remove unwanted deposits. Some of these tools did not reach into the slots or perforations. Those with wires or feelers thin enough to enter the slot or perforation were often too thin to provide much cleaning force. Several types of washing tools are available which use pressurized jets of fluid in an attempt to dislodge undesired material from well tubulars. The development of jet cleaning has advanced from low velocity for use in cleaning and acidizing to abrasive particles suspended in high pressure fluids. Abrasives are used for cleaning flow conductors, but with results less than favorable since the flow conductors are sometimes eroded along with the foreign material plugging or coating the flow conductors.

U.S. Pat. No. 4,625,799 discloses a mechanically indexed cleaning tool. U.S. Pat. No. 4,705,107, discloses the use of boiler type cleaning equipment to clean well tubulars downhole. U.S. Pat. No. 4,781,250 discloses a cleaning tool indexed by fluid pressure changes. Development of apparatus from these patents led to the present invention.

The preceding patents are incorporated by reference for all purposes within this application.

SUMMARY OF THE INVENTION

The present invention is directed towards improved methods and apparatus for cleaning well tubulars using coil tubing or other small diameter work strings.

One object of the invention is to provide a fluid powered rotating nozzle to remove scale and other deposits from the inside diameter of a well tubular.

Another object of the present invention is to provide fluid jet cleaning apparatus with stationary and rotating jet nozzles.

A further object of the present invention is to provide fluid jet cleaning apparatus with jet nozzles oriented at various angles relative to the longitudinal axis of the cleaning apparatus.

A still further object of the present invention is to provide cleaning apparatus with jet nozzles combined with a mechanical cleaning tool to remove all types of downhole deposits.

Additional objects and advantages of the present invention will be readily apparent to those skilled in the art after studying the written description in conjunction with the drawings and claims.

DESCRIPTION OF THE PREFERRED EMBODIMENTS

Figure 1:
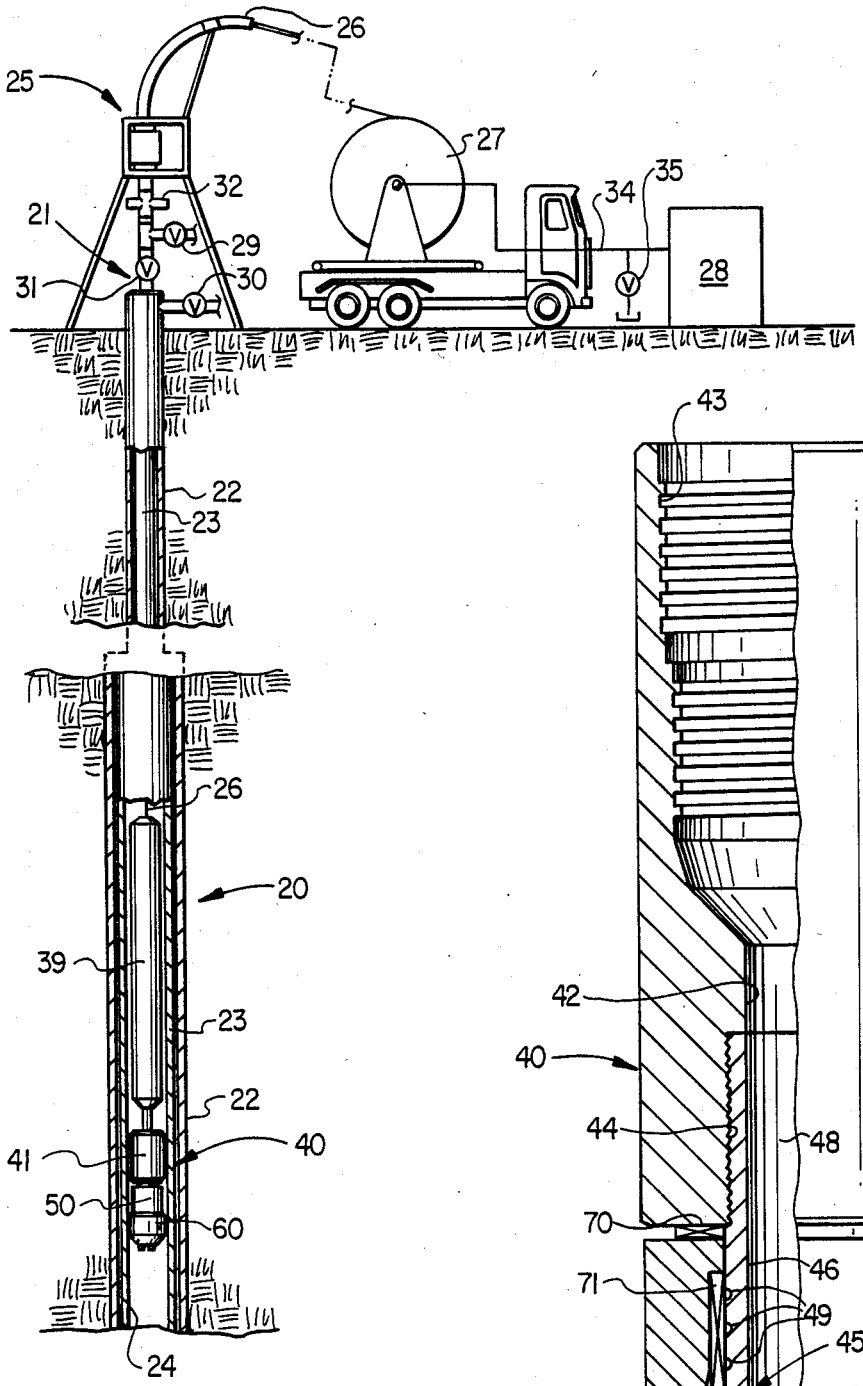
FIG. 1 is a schematic drawing partially in elevation and partially in section with portions broken away showing a coil tubing unit and fluid jet cleaning apparatus removing deposits from the inside diameter of a well tubular.

In FIG. 1 well 20 extends from wellhead 21 to an underground hydrocarbon or fluid producing formation (not shown). Well 20 is defined in part by casing string 22 with production tubing string 23 disposed therein. This embodiment will be described with respect to tubing string 23. However, the present invention can be used with other types of well tubulars or flow conductors including liners and well screens. Also, the present invention is not limited to maintenance of oil and gas wells.

During the production of formation fluids, various types of deposits may accumulate on the inside diameter of the well tubulars or flow conductors. Examples of soft deposits are clay, paraffin, and sand. Examples of hard deposits are silicates, sulphates, sulphides, carbonates and calcium. The present invention is particularly useful for removal of deposits found in geothermal and oil wells but may be satisfactorily used to remove other types of deposits.

Using conventional well servicing techniques, injector 25 can be mounted on wellhead 21. Coil tubing or work string 26 from reel 27 is inserted by injector 25 into bore 24 of tubing string 23. Filter 39 and fluid jet cleaning apparatus 40 are attached to the lower end of coil tubing 26. Manifold 28 includes the necessary pumps, valves, and fluid reservoirs to discharge high pressure cleaning fluid (power fluid) into bore 24 via coil tubing 26. Manifold 28 is connected to reel 27 by power fluid supply line 34. Regulating valve or dump valve 35 is provided in supply line 34. Valves 29 and 30 can be used to control the return of spent power fluid to the well surface. Wellhead valve 31 is used to control vertical access to and fluid communication with bore 24 of tubing string 23. Blowout preventers 32 are normally installed between wellhead 21 and injector 25 to block fluid flow during emergency conditions.

Figure 2:
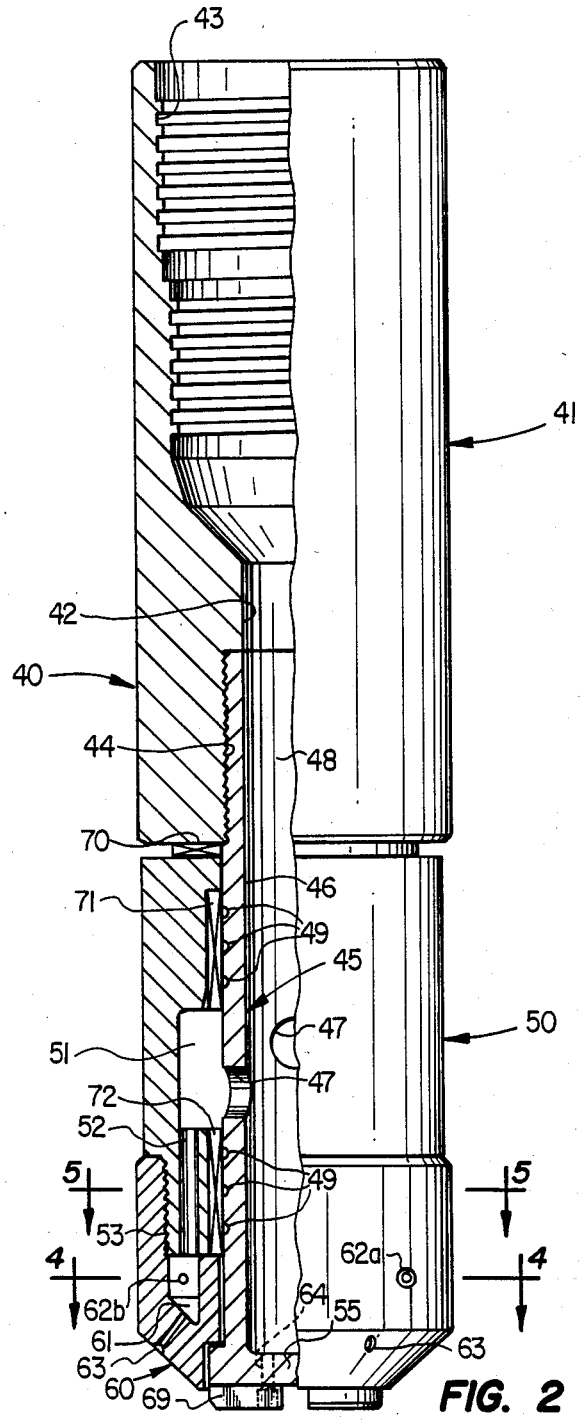
FIG. 2 is an enlarged drawing partially in section and partially in elevation showing the fluid jet cleaning apparatus of FIG. 1.
Figure 3:
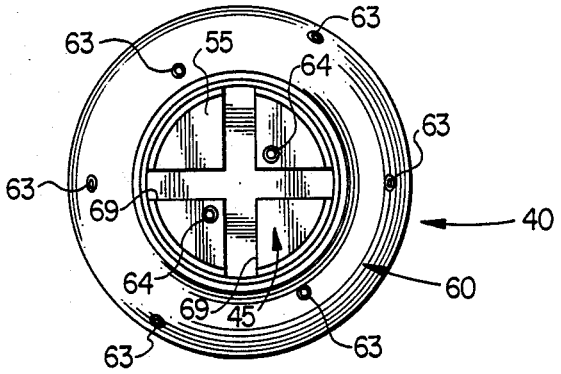
FIG. 3 is an end view of the jet cleaning apparatus of FIG. 2.

As best shown in FIG. 2, cleaning apparatus 40 consists of four major components —adapter 41, inner mandrel 45, rotatable housing 50, and nozzle body 60. Bearing means 70, 71 and 72 are located on inner mandrel 45 to allow rotation of housing 50 and nozzle body 60 relative thereto. Adapter 41, similar to a tool joint, is a generally short cylindrical coupling with longitudinal passageway 42 extending therethrough. Heavy duty threads 43 are formed within one end of passageway 42 to connect with the lower end of filter 39 or directly onto work string 26 if filter 39 in not used. Threads 44 are formed in the opposite end of passageway 42 to connect inner mandrel 45 therewith. Longitudinal bore 46 extends at least partially through inner mandrel 45 and is aligned to receive power fluid flow from passageway 42. A plurality of ports 47 are machined radially through inner mandrel 45 intermediate the ends thereof to allow fluid communication between the interior and the exterior of inner mandrel 45. Fluid flow path 48 which communicates power fluid from work string 26 to housing 50 includes passageway 42, longitudinal bore 46, and ports 47. Annular chamber 51 is provided within housing 50 to receive power fluid from ports 47. A plurality of longitudinal openings 52 are provided between annular chamber 51 and nozzle body 60. Matching threads 53 are used to attach nozzle body 60 to housing 50 to receive fluid communication from longitudinal openings 52.

Nozzle body 60 has its own annular chamber 61 to receive power fluid from longitudinal openings 52. A plurality of fluid jet nozzles extend through nozzle body 60 at various angles relative to the longitudinal axis of inner mandrel 45 to allow power fluid to exit from the jets and remove deposits from the inside diameter of well tubulars 22 or 23. One pair of jet nozzles 62*a* and 62*b* are machined into nozzle body 60 diametrically opposite from each other and oriented to project power fluid essentially tangential to annular chamber 61 or at a ninety degree angle relative to both the diameter of nozzle body 60 and the longitudinal axis of inner mandrel 45. Jet nozzles 62*a* and 62*b* are oriented to cause power fluid exiting therefrom to rotate housing 50 and nozzle body 60 and thereby significantly increase the removal of deposits from the inside diameter of well tubulars adjacent thereto.

Fluid jet nozzles 63 extend through nozzle body 60 at various angles relative to the longitudinal axis of inner mandrel 45. The orientation and number of jet nozzles 63 is selected to allow power fluid exiting from jets 63 to remove deposits from the inside diameter of well tubulars 22 or 23. Their orientation and number varies depending upon the type and depth of the downhole deposit, the inside diameter of the well tubular, flow characteristics of the power fluid, pumping capacity of manifold 28, etc. Preferrably, inner mandrel 45 has one or more fluid jet nozzles 64 in its extreme lower end 55 to receive power fluid from flow path 48. Jet nozzles 64 are oriented to project power fluid essentially parallel to the longitudinal axis of inner mandrel 45. Slots 69 are machined in lower end 55 to aid in the assembly of cleaning apparatus 40.

A wide variety of commercially available bearings could be used for bearing means 70, 71, and 72. Self-lubricating bearings made from a composite material consisting of a metal backup ring and a porous bronze layer impregnated with polytetrafluoroethylene have been used satisfactorily. Such bearings are available from Garlock Inc. Radial bearings 71 and 72 are spaced longitudinally from each other between the exterior of inner mandrel 45 and the inside diameter of housing 50. Ports 47 are disposed between radial bearings 71 and 72. A set of three small grooves 49 are provided in the exterior of inner mandrel 45 adjacent to each bearing 71 and 72 respectively. Grooves 49 cooperate with their respective bearing 71 or 72 to act as a fluid barrier and restrict undesired fluid flow form annular chamber 51. Thrust bearing 70 is positioned between the adjacent ends of housing 50 and adapter 41. Bearing 70 prevents thrust forces generated by power fluid exiting nozzle body 60 from restricting rotation of housing 50.

OPERATING SEQUENCE

FIG. 1 shows the system for supplying power fluid to cleaning apparatus 40 to remove deposits from well tubular or flow conductor 23 after cleaning apparatus 40 was being inserted therein. Reeled tubing injector 25 is used to position cleaning apparatus 40 at the desired location in the flow conductor. Power fluid is supplied to flow path 48 from manifold 28 via coil tubing 26. A small amount of power fluid is projected directly from flow path 48 via jet nozzles 64 to initially breakup any deposits below cleaning apparatus 40. Most of the power fluid supplied to flow path 48 is directed to annular chamber 61 via radial ports 47 and longitudinal openings 52. A portion of the power fluid exits from jet nozzles 62a and 62b to cause rotation of housing 50 and nozzle body 60 relative to inner mandrel 45. The major portion of the power fluid exits from jet nozzles 63 to remove undesired downhole deposits.

FIG. 1 shows tubing 23 with an outside diameter only slightly smaller than the inside diameter of casing 22. For many well completions, there may be a substantial difference in the size of the downhole well flow conductors. Nozzle body 60 can be selected to have jet nozzles 63 optimized to clean the relatively small inside diameter of a typical production tubing string or optimized to clean the relatively large inside diameter of a typical casing string. An important advantage of the present invention is the ability to insert a work string and cleaning apparatus 40 with relatively small outside diameters through tubing 23 to clean the relatively larger inside diameter of casing 22 below the lower end (not shown) of tubing 23.

The speed of rotation of nozzle body 60 is a function of the size of jet nozzles 62a and 62b, fluid flow rate through flow path 48, the type of power fluid, downhole well fluids, and the characteristics of bearing means 70, 71, and 72. Power fluid discharged from cleaning apparatus 40 is returned to the well surface via valves 29 or 30. Spent power fluid is used to remove the deposits from the well bore. For some well conditions nitrogen gas may be mixed with the power fluid to increase its ability to lift debris from the well bore.

ALTERNATIVE EMBODIMENT

Figure 6:
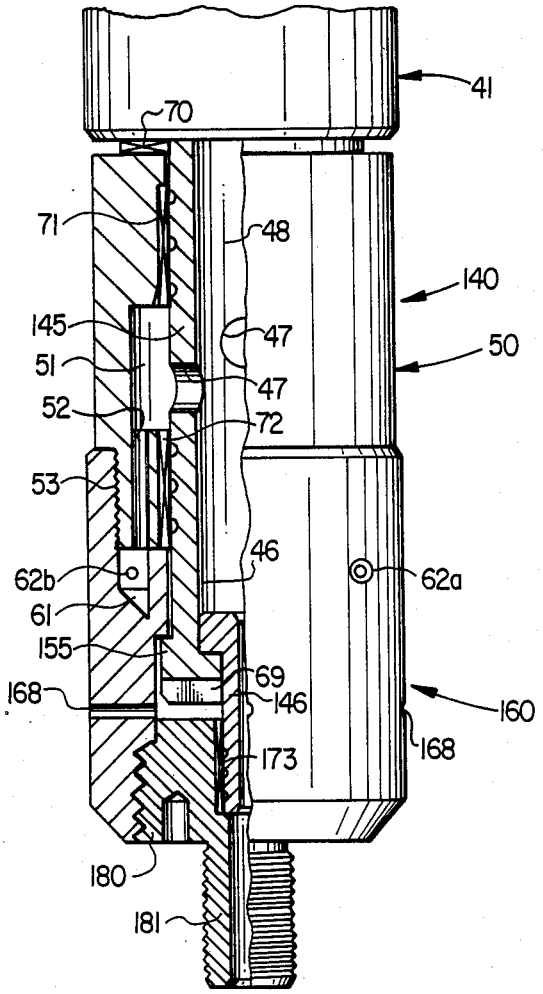
FIG. 6 is a schematic drawing partially in elevation and partially in section showing an alternative fluid jet cleaning apparatus which can be used to rotate a mechanical cleaning tool.
Figure 5:
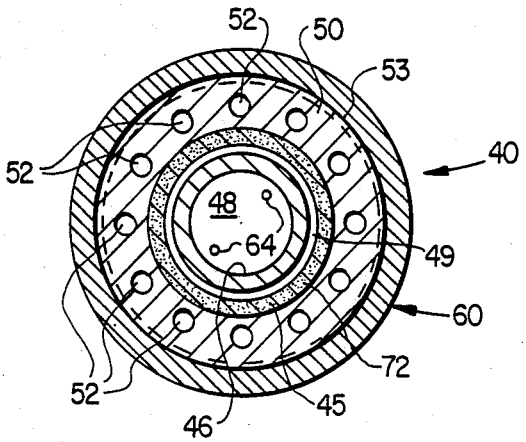
FIG. 5 is a drawing in section taken along line 5—5 of FIG. 2.

An alternative fluid jet cleaning apparatus 140 is shown in FIG. 6. Adapter 41 may be used to attach cleaning apparatus 140 to the lower end of coil tubing 26. Fluid jet cleaning apparatus 140 includes many of the same components as cleaning apparatus 40. Such components will be given the same numerical designation for both cleaning apparatus 40 and 140. Power fluid flows from coil tubing 26 through flow path 48 to annular chamber 61 in the same manner as described for cleaning apparatus 40. Power fluid exits from jet nozzles 62a and 62b to rotate housing 50 and modified nozzle body 160. Inner mandrel 145 has been modified as compared to cleaning apparatus 40 to provided flow tube 146 extending through lower end 155. Most of the power fluid in flow path 48 exits through flow tube 146 as compared to jet nozzles 62a and 62b. For downhole deposits requiring increased rotation force to clean, extra tangential jet nozzles 62c, 62d, etc. (not shown) may be added. Also, fluid exiting from flow tube 146 may be restricted by an orifice or choke (not shown). Bearing means 70, 71, and 72, located on inner mandrel 145 and bearing means 173 located on flow tube 146 allow rotation of housing 50 and nozzle body 160 relative to inner mandrel 145.

Figure 7:
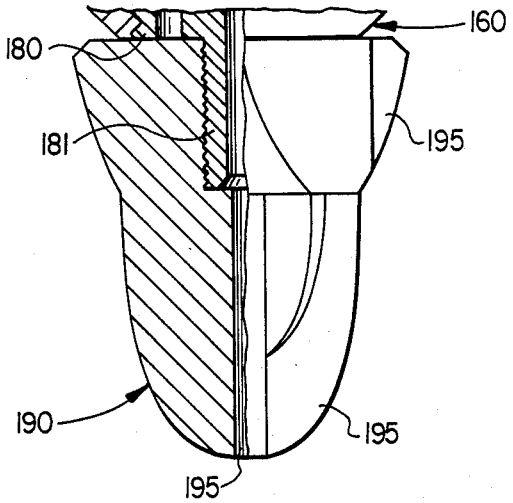
FIG. 7 is a schematic drawing partially in elevation and partially in section showing a mechanical cleaning tool attached to the alternative fluid jet cleaning apparatus of FIG. 6.
Figure 4:
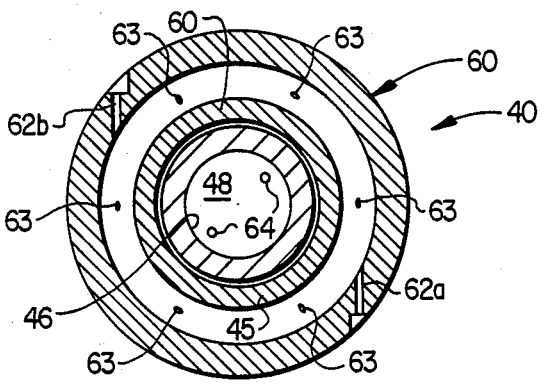
FIG. 4 is a drawing in section taken along line 4—4 of FIG. 2.

Nozzle body 160 includes means for attaching various mechanical cleaning tools to cleaning apparatus 140. Connector 180 is threaded into the lower end of nozzle body 160 with hollow shaft 181 projecting therefrom. Flow tube 146 and hollow shaft 181 are preferrably aligned with each other to allow power fluid flow therethrough. Various sizes and types of mechanical cleaning tools can be attached to hollow shaft 181 corresponding to the size of the well flow conductor and the type of deposit to be cleaned. Cleaning tool 190 is shown in FIG. 7. Radially drilled holes 168 are provided in nozzle body 160 to allow a limited amount of power fluid to flow past bearing means 72 for cooling purposes.

For deposits such as sand bridge (not shown) which completely block tubing string 23, cleaning tool 190 is preferably used. The exterior of cleaning tool 190 has serrations 195 to remove deposits from the interior of well flow conductors. The efficiency of serrations 195 is greatly increased by having power fluid from flow passageway 48 exit drilled opening 196 and flow upwardly therepast. The power fluid flow path of fluid jet cleaning apparatus assembly 140 optimizes both the rotational effect of serrations 195 and the lifting of loosened deposits by spent power fluid to the well surface.

Cleaning apparatus 140 with mechanical cleaning tool 190 attached can be lowered into tubing string 23 to contact a sand bridge. Power fluid exiting from jets 62a and 62b will rotate housing 50, nozzle body 160, and cleaning tool 190. The rotation of serrations 195 and power fluid exiting opening 196 will break up and lift the debris. Additional spent power fluid from jets 62a and 62b will further assist with lifting the sand and other debris to the well surface. Thus, the present invention can be readily adapted for hydraulic or mechanical drilling of downhole deposits.

The previous description is illustrative of only some embodiments of the present invention. Those skilled in the art will readily see other variations and modifications without departing from the scope of the invention as defined in the claims.

We claim:

1. A system for cleaning the inside diameter of well tubulars comprising:

a. a work string disposed within the well tubular;
b. means for longitudinally moving the work string within the well tubular;
c. means for supplying power fluid to the work string;
d. fluid jet cleaning apparatus attached to the end of the work string within the well tubular;
e. the jet cleaning apparatus having an inner mandrel and an adapter to connect the apparatus to the work string;
f. a housing rotatably carried on the exterior of the inner mandrel;
g. a fluid flow path from the work string to the housing via the inner mandrel;
h. a nozzle body attached to the housing and in fluid communication therewith;
i. a pair of jet nozzles machined into the nozzle body diametrically opposite from each other and oriented to project power fluid essentially tangential to the nozzle body whereby power fluid exiting from the pair of jet nozzles will cause rotation of the housing and the nozzle body to remove deposits from the inside diameter of the well tubular; and
j. the longitudinal moving means comprising a coil tubing injector.

2. The system as defined in claim 1 wherein the power fluid supply means comprises:

a. the work string; and
b. a source of power fluid at the well surface.

3. A system as defined in claim 1 further comprising bearing means disposed between the inner mandrel and the housing.

4. A system as defined in claim 3 wherein the bearing means further comprises:

a. a radial bearing between the housing and the inner mandrel to aid rotation of the housing relative thereto; and b. a thrust bearing between the housing and the adapter to prevent thrust forces generated by power fluid exiting the nozzle body from restricting rotation of the housing.

5. A system as defined in claim 4 wherein the inner mandrel further comprises:

a. a longitudinal bore extending at least partially therethrough and comprising a portion of the flow path for power fluid to the housing; and b. one or more fluid jets in the extreme lower end of the inner mandrel to allow power fluid to exit therefrom.

6. A system as defined in claim 5 wherein the inner mandrel further comprises one or more of the fluid jets in the extreme lower end of the inner mandrel projecting power fluid essentially parallel to the longitudinal axis of the inner mandrel.

7. A system as defined in claim 5 wherein the nozzle body further comprises means for attaching a mechanical cleaning tool whereby rotation of the housing and the nozzle body results in rotation of the cleaning tool.

8. A system as defined in claim 3 wherein the nozzle body further comprises a plurality of fluid jets extending therethrough at various angles relative to the longitudinal axis of the inner mandrel to allow power fluid to exit from the jets to remove deposits from the inside diameter of the well tubular.

9. A system for cleaning the inside diameter of well tubulars comprising:

a. a work string disposed within the well tubular;

b. means for longitudinally moving the work string within the well tubular;

c. fluid jet cleaning apparatus attached to the extreme end of the work string within the well tubular;

d. means for supplying power fluid to the fluid jet cleaning apparatus;

e. a housing and nozzle body rotatably attached to the fluid jet cleaning apparatus;

f. the nozzle body having at least one jet nozzle formed therein to allow power fluid to exit on a tangent relative thereto whereby the exiting power fluid will cause rotation of the housing and the nozzle body to remove deposits from the inside diameter of the well tubular;

g. a pair of jet nozzles machined into the nozzle body diametrically opposite from each other and oriented to project power fluid essentially tangential to the nozzle body whereby power fluid exiting from the jet nozzles will cause rotation of the housing and the nozzle body to remove deposits from the inside diameter of the well tubular; and h. the nozzle body further comprises a plurality of fluid jets extending therethrough at various angles relative to the longitudinal axis of the inner mandrel to allow power fluid to exit from the jets to remove deposits from the inside diameter of the well tubular.

10. A system as defined in claim 9 wherein the inner mandrel further comprises one or more fluid jets in the extreme lower end of the inner mandrel projecting power fluid essentially parallel to the longitudinal axis of the inner mandrel.

11. A system as defined in claim 9 wherein the nozzle body further comprises means for attaching a mechanical cleaning tool whereby rotation of the housing and the nozzle body results in rotation of the cleaning tool.

12. A fluid jet cleaning apparatus for cleaning the inside diameter of well tubulars comprising:

a. an inner mandrel and an adapter to connect the cleaning apparatus to a work string;

b. a housing rotatably carried on the exterior of the inner mandrel;

c. a fluid flow path from the work string to the housing via the inner mandrel;

d. a nozzle body attached to the housing and in fluid communication therewith;

e. a pair of jet nozzles machined into the nozzle body diametrically opposite from each other and oriented to project power fluid at essentially a ninety degree angle relative to the longitudinal axis of the inner mandrel whereby power fluid exiting from the pair of jet nozzles will cause rotation of the housing and the nozzle body to remove deposits from the inside diameter of the well tubular;

f. the flow path comprising a plurality of ports extending radially through the inner mandrel to allow fluid communication with the housing; and g. the housing disposed on the exterior of the inner mandrel to cover the ports and form an annular chamber to receive power fluid from the flow path.

13. Fluid jet cleaning apparatus as defined in claim 12 further comprising the plurality of fluid jets near the lower end of the nozzle body whereby rotation of the nozzle body produces hydraulic drilling action.

14. Fluid jet cleaning apparatus as defined in claim 12 further comprising means for attaching a mechanical cleaning tool to the nozzle body whereby rotation of the housing and the nozzle body results in rotation of the mechanical cleaning tool.

* * * * *